United States Patent [19]

Moore

[11] 4,005,650

[45] Feb. 1, 1977

[54] PRINT HAMMER

[75] Inventor: Donn F. Moore, Utica, Mich.

[73] Assignee: Computer Peripherals, Inc., Rochester, Mich.

[22] Filed: July 16, 1975

[21] Appl. No.: 596,348

Related U.S. Application Data

[63] Continuation of Ser. No. 431,110, Jan. 7, 1974.

[52] U.S. Cl. ..... 101/111; 101/93.48; 101/398; 197/36

[51] Int. Cl.[2] ..... B41J 1/20; B41J 9/02; B41B 1/02

[58] Field of Search ..... 101/93.02, 93.03, 93.19, 101/93.3, 96, 111, 398, 399, 401.1, 401.2, 401.5, 401.6, 368, 31, 93.48, 379; 197/36, 49

[56] References Cited

UNITED STATES PATENTS

| | | | |
|---|---|---|---|
| 2,175,530 | 10/1939 | Knutsen | 101/93.25 |
| 3,090,297 | 5/1963 | Wilkins et al. | 101/93.03 |
| 3,164,084 | 1/1965 | Paige | 101/111 X |
| 3,183,830 | 5/1965 | Fisher et al. | 101/93.03 |
| 3,202,257 | 8/1965 | Rihm | 197/36 |
| 3,224,366 | 12/1965 | Cunningham | 101/111 X |
| 3,266,419 | 8/1966 | Erpel et al. | 101/93.19 |
| 3,335,659 | 8/1967 | Schacht et al. | 101/93.02 |
| 3,351,007 | 11/1967 | Poland | 101/93.3 |
| 3,381,790 | 5/1968 | Chavemeaud et al. | 197/49 X |
| 3,386,376 | 6/1968 | Mutz et al. | 101/93.02 |
| 3,556,002 | 1/1971 | Bragg | 101/93.48 |
| 3,741,110 | 6/1973 | Bossi | 101/111 X |
| 3,795,187 | 3/1974 | Babler | 101/93.3 |
| 3,835,771 | 9/1974 | Funk et al. | 101/111 |

*Primary Examiner*—Edgar S. Burr
*Assistant Examiner*—Paul J. Hirsch
*Attorney, Agent, or Firm*—J. T. Cavender; Wilbert Hawk, Jr.; George J. Muckenthaler

[57] ABSTRACT

The impact tip of the print hammer is provided with a curved face in one direction and shaped in a cylindrically-arcuate configuration. The impact tip is formed with the surface curvature in a direction perpendicular to the direction of character height and in a convexly curved or rounded manner as viewed from the type character. This structure of the impact tip together with an optimum chamfer angle of the type character permits closer spacing of the characters.

4 Claims, 5 Drawing Figures

PRINT HAMMER

This is a continuation of application Ser. No. 431,110, filed Jan. 7, 1974.

BACKGROUND OF THE INVENTION

In the field of high speed printing, the belt or chain type of character carrier has a plurality of slugs with characters thereon and the slugs, along with their characters, are spaced as closely as possible. The principal motivation for using the horizontal or train type of character carrier is for improved print alignment, and along with such closely spaced characters, higher printing speeds are achieved. As is well known, the use of a type drum for high speed printing has the disadvantages of both higher cost and the occupation of more space, so the belt or chain type carrier is rapidly replacing the type drum in certain applications.

Various ways and means have been developed over the years in printers to increase the speed of printing while decreasing cost and size of such units. It is, of course, extremely important that the quality of the print, as to clearness and sharpness of the printed matter, be maintained so that smudging, ghosts, or the like do not exist. In the case of type drums, the hammer tip is sometimes curved in a manner to conform or coincide with the curvature of the drum and of sufficient magnitude to cover substantially more area than that of a single character, such as is disclosed in Hartley U.S. Pat. No. 2,776,618.Likewise, Rosen et al. U.S. Pat. No. 2,805,620 shows a hammer face curved generally in accordance with the drum surface. A type bar with interchangeable type having curved faces is disclosed in Redmond U.S. Pat. No. 2,862,592. Also, Wilkins et al. U.S. Pat. No. 3,090,297 shows a hammer slug with a curved face compatible with that of the type drum. A different approach in a curved hammer face is disclosed in Pensavecchia et al. U.S. Pat. No. 3,185,083 wherein the impact tip is curved away from the curvature of the drum. Solheim et al. U.S. Pat. No. 3,309,989 provides ribbon guides supported in a curved manner to clear adjacent characters upon hammer impact, and finally, Muterspaw U.S. Pat. No. 3,604,347 discloses a concave shaped face to provide uniform print density.

SUMMARY OF THE INVENTION

The present invention relates to high speed printers and, more particularly, to print hammers having an impact tip of curved configuration to provide for reduced spacing between adjacent type characters. The impact tip of the hammer is formed with a cylindrically-shaped arcuate portion which is convex by definition as viewed from the character, the sides of the tip being on a line parallel with and approximating the up-and-down portion of the type character. Such impact tip has a curvature wherein normals at neighboring points diverge in relation to the type characters to permit flexure of the printing medium around the curvature. The impact tip curvature along with an optimum chamfer angle of the type characters permits closer spacing of the characters.

In view of the above, the principal object of the present invention is to provide apparatus for attaining higher printing speeds in a printer.

Another object of the present invention is to provide a print hammer with a curved face to reduce adjacent character images.

An additional object of the present invention is to provide printing apparatus enabling closer spacing of the type characters.

A further object of the present invention is to provide printing apparatus permitting flexing of the paper and ribbon for clearance between the print hammer and an adjacent type character.

Additional features and advantages will become apparent and fully understood from a reading of the following specification taken together with the annexed drawings, in which.

Figure 1:
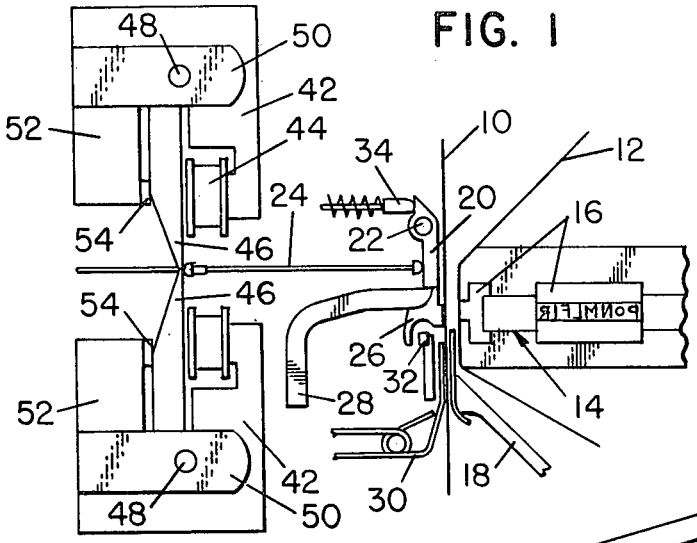
FIG. 1 is a side elevational view of printing apparatus incorporating the structure of the present invention.

Referring now to the drawing, FIG. 1 shows a portion of a printer incorporating the subject matter of the present invention, wherein paper 10 is caused to be propelled along a path perpendicular to a line of print hammers and type elements or characters, it being wellknown that, in a typical printer, there are a plurality of such hammers and type characters operating to produce printing on the paper. Of course, carbon paper or a ribbon 12 is adjacent the paper 10 so as to cause imprinting on the paper upon impact of the hammer against the paper, the ribbon, and the type character. The type characters are carried on a moving belt-or-chain like member 14 (also called a train) which is continuously driven in one direction past the printing station, the characters being supported from type slugs, such as shown at 16, attached to the belt or chain. Appropriate pulsing and firing of the hammers at preselected times against the type characters thereby imparts desired printing on the paper 10. A linefinder element 18 is provided adjacent the printing station to aid in positioning the paper.

Each of the impact hammers 20 is carried on a pivot pin 22 and adapted to be swung thereabout by force from a push rod assembly 24, the hammer having an impact tip 26 engageable with the paper 10. A guide comb 28 is provided to maintain the hammers in a prescribed path of flight and to control the travel and movement thereof, and a forms compressor 30 is positioned under the printing station to urge the paper into proper condition prior to printing thereon. An impression pad 32 is provided for energy control of the hammer in relation to the paper and to accommodate for various forms thicknesses and number of copies, and a return spring mechanism 34 affords antirebound protection for the hammer.

The impact force for the hammers 20 is normally accomplished by means of an electromagnetic apparatus which is pulsed at desired intervals to obtain a high speed printing operation. Such apparatus includes a magnetic core 42 that is energized by a coil 44 to attract an armature 46 pivoted on a pin 48. The pin is held in place and supported by bearing plates 50 (only one of which is shown). The stroke of the armature 46 is limited and controlled by means of a stop 52 on which is mounted a small resilient pad 54, the stop 52 being secured to the core 42 by suitable means such as screws or the like.

Of course, it is required that the print hammers and their actuating members be closely aligned in side-by-side relationship so as to reduce the space across the printing station. As seen in FIG. 1, this is partially accomplished by providing supporting structure for the print magnet assemblies wherein a lower row and an upper row of assemblies are arranged in slightly staggered manner so as to properly actuate the respective push rods 24 for the respective impact hammers 20.

Figure 2:
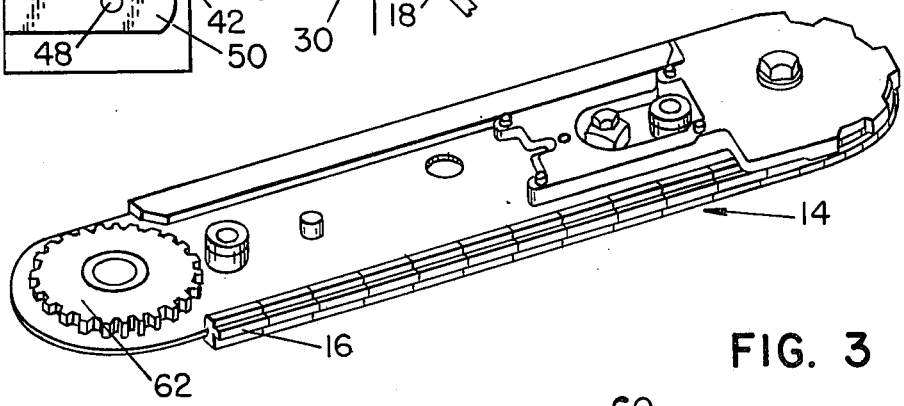
FIG. 2 is a perspective view of a belt or chain type printer cooperable with the print hammer of the present invention.
Figure 3:
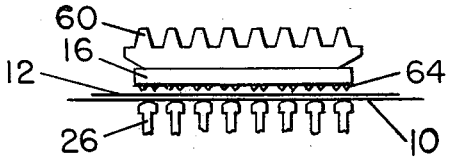
FIG. 3 is a top plan view of a type slug positioned adjacent the print hammers.

Referring now to FIG. 2, the type character carrier, in the form of a belt-or-chain device 14 is driven in continuous manner in one direction to propel the type slugs 16 past the printing hammers 20, the type slugs being closely spaced and including teeth 60 (FIG. 3) for engagement with the sprockets 62 (only one shown). The required structure is included with the sprockets 62 to provide a complete assembly for carrying the type slugs 16, each of which contains eight type characters 64 in spaced relationship, as seen from the plan view thereof in FIG. 3 with the impact hammer tips 26 oppositely disposed therewith.

Figure 4:
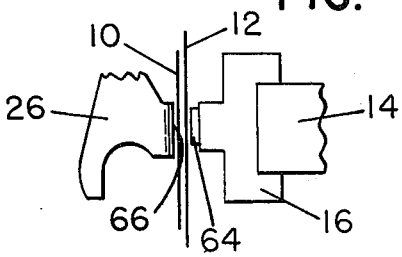
FIG. 4 is an enlarged side elevational view of the hammer tip and type slug arrangement.
Figure 5:
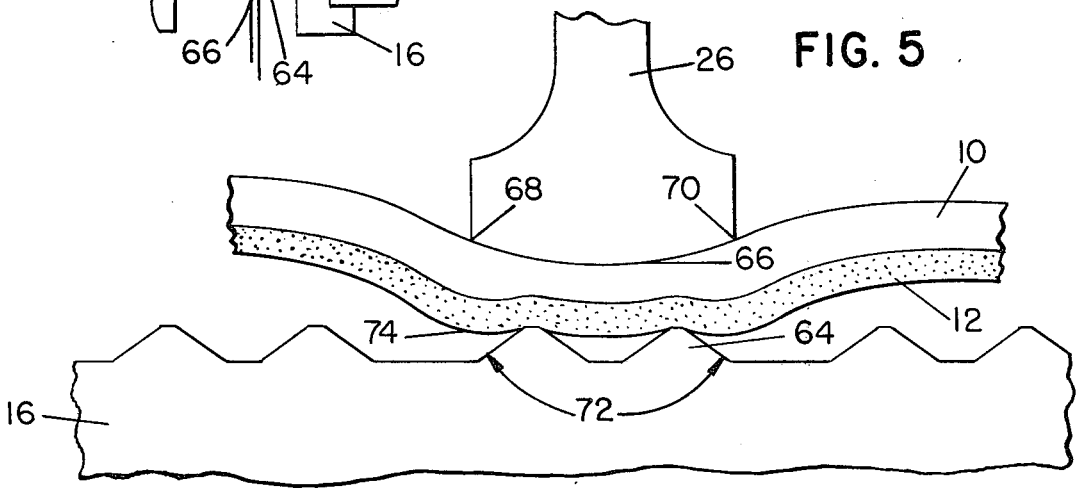
FIG. 5 is an enlarged plan view of a portion of the structure shown in FIG. 3.

An enlarged side view of the printing area is shown in FIG. 4, the impact hammer 26 being aligned with the path of the type characters 64, with the paper 10 and ribbon 12 between the hammer and characters, and the hammer 26 having a curvature on its impact face 66 convexly formed as viewed from the character 64. The particular construction of the impact face 66 is best seen in FIG. 5 as being cylindrically-arcuate shaped with planes 68 and 70 being receded from the mid-point of the face by an equal dimension. Such particular shape is defined in one manner as being that side of a curve or surface on which the tangent line or plane lies, or on which normals at neighboring points diverge.

By reason of the receded planes 68 and 70 from the mid-point of the face of the hammer impact tip, the paper 10 and the ribbon 12 are allowed to flex and assume a position and condition corresponding to the curvature of the face. The particular shape of the impact face, that corresponding to a rectangular curve and dimensioned to the type character, together with an optimum chamfer angle of the type characters enables closer spacing of such characters, the reduction in spacing being in the range of 10 percent. The included angle of chamfer, designated at 72, of the type character has been increased from approximately 70° to 110° thereby permitting the paper and the ribbon to extend in a flexure manner, as at 74, but, at the same time, limiting the extension of the paper and ribbon in such flexure manner to prevent or at least reduce the amount of smudging on the paper 10.

It is thus seen that herein shown in described is a print hammer having an impact face to provide for closer spacing of the type characters for high speed operation. The particular structure enables the accomplishment of the objects and advantages mentioned above, and while only one embodiment of the invention has been disclosed herein, certain variations may occur to those skilled in the art. It is contemplated that all such variations, not departing from the spirit and scope of the invention hereof, are to be construed in accordance with the following claims.

What is claimed is:

1. A print hammer for printing on record media in a printer having type characters movable along a path adjacent the hammer, each of said type characters having an included angle of chamfer greater than a right angle, said record media being located between said print hammer and said type characters, and means for actuating said hammer into contact with said record media and against said characters, said hammer including an impact face defined by spaced side edge portions and having a curvature of predetermined length from one side edge portion along said curvature to the other side edge portion and assuming a convex shape in which normals at neighboring points diverge in relation to one of said type characters, thereby causing flexure of said record media around said curvature upon impact of said face therewith and against said character, said angle of chamfer limiting the extent of flexure of said record media adjacent said character upon the impacting of said hammer against the record media.

2. The print hammer of claim 1 wherein the impact face includes straight end edge portions and is generally rectangular in one direction and has a curvature in the other direction starting at one of said side edge portions, arcuately advancing to the midpoint of the face nearer the type characters than the first-mentioned side edge portion, and arcuately receding to a like-defined edge portion distal from said first side edge portion.

3. In printing apparatus for printing on a printing medium, said apparatus having type characters movable in a path along a plurality of print hammers, each of said type characters having an included angle of chamfer greater than a right angle, said printing medium being adjacent said print hammers in position to be struck by said hammers against said characters, and each of said hammers including an impact tip defined by spaced parallel side edge portions and having a curvature of predetermined length from one side edge portion along said curvature to the other side edge portion and assuming a convex shape in which normals at neighboring points diverge in relation to a respective character, thereby causing flexure of said printing medium around said curvature upon striking of said hammers against said characters, the extent of flexure of said printing medium adjacent the type character during said hammer striking thereof being limited by said angle of chamfer of said type character so as to enable closer spacing of said type characters.

4. The apparatus of claim 3 wherein the impact tip includes straight end edge portions and is generally rectangular in shape in one direction and has a curvature in the other direction starting at one of said side edge portions, arcuately advancing uniformly to the midpoint of the tip nearer the type character than the first-mentioned edge portion, and arcuately receding uniformly to the like-defined side edge portion distal from said first side edge portion.

* * * * *